US006513191B1

(12) United States Patent
Kim

(10) Patent No.: US 6,513,191 B1
(45) Date of Patent: Feb. 4, 2003

(54) DEVICE FOR ADJUSTING SUCTION PIPE LENGTH OF A VACUUM CLEANER

(75) Inventor: Yoon-ki Kim, Kwangju (KR)

(73) Assignee: Kwang Dong Precision Co., Ltd., Kwangju (KR)

( * ) Notice: Subject to any disclaimer, the term of this patent is extended or adjusted under 35 U.S.C. 154(b) by 0 days.

(21) Appl. No.: 09/856,965

(22) PCT Filed: Feb. 18, 2000

(86) PCT No.: PCT/KR00/00132

§ 371 (c)(1),
(2), (4) Date: May 30, 2001

(87) PCT Pub. No.: WO01/41620

PCT Pub. Date: Jun. 14, 2001

(30) Foreign Application Priority Data

Dec. 11, 1999 (KR) ..... 99-27915 U

(51) Int. Cl.[7] ..... A47L 9/24
(52) U.S. Cl. ..... 15/414; 285/7
(58) Field of Search ..... 15/144.4, 377, 15/414; 285/7, 145.1, 145.4

(56) References Cited

U.S. PATENT DOCUMENTS 5,332,266 A * 7/1994 Canale
5,692,782 A * 12/1997 Fischer
5,740,583 A * 4/1998 Shimada et al.
6,148,474 A * 11/2000 Ohara et al.
6,237,962 B1 * 5/2001 Lim

FOREIGN PATENT DOCUMENTS

| | | |
|---|---|---|
| EP | 552481 | * 7/1993 |
| JP | 64-32832 | 2/1989 |
| JP | 9-56648 | 3/1997 |
| KR | 91-10810 | 7/1991 |
| KR | 1998-68885 | 12/1998 |

* cited by examiner

*Primary Examiner*—Terrence R. Till
(74) *Attorney, Agent, or Firm*—Sughrue Mion, PLLC

(57) ABSTRACT

A device for adjusting a length of a suction pipe of a vacuum cleaner includes a sleeve connected to one end of an outer pipe, and having a pair of limiting projections formed on an outer circumference of the outer pipe, a slot defined between the projections, and a guide projection formed on the inner circumference of the sleeve; a locking plate inserted in the slot of the sleeve, and having a pair of locking projections inserted in a pair of neighboring locking recesses; a pair of arc-shaped pressing plates connected between the pair of projections, the pressing plates having cam grooves; and a sliding cover securely positioned by elastic means, the sliding cover having operating projections which are movably inserted in the cam grooves of the pair of pressing plates.

5 Claims, 8 Drawing Sheets

DEVICE FOR ADJUSTING SUCTION PIPE LENGTH OF A VACUUM CLEANER

BACKGROUND OF THE INVENTION

1. Field of the Invention

This device relates to a vacuum cleaner, and more particularly, this device is for adjusting a length of a suction pipe of a large capacity vacuum cleaner capable of adjusting the length of the suction pipe appropriately according to need of situation.

2. Description of the Related Art

Generally, a vacuum cleaner generates a strong suction force in a dust chamber by a driving of a motor mounted in a cleaner body. The dust chamber is connected to a suction pipe through a flexible hose, and accordingly, air and ambient contaminants are drawn into the dust chamber through the suction pipe and the flexible hose. Accordingly, the cleaning process is performed automatically. Meanwhile, when the length of the hose or the suction pipe is improper for user's desired cleaning place, i.e., when the hose or the suction pipe is shorter or longer than the user requires, then the user adjusts the length of the suction pipe excluding the hose which is not adjustable.

FIG. 1 schematically shows the construction of the conventional device for adjusting the length of the suction pipe of a vacuum cleaner, which is representatively disclosed in the EP 0 552 481 A1. The length adjusting device includes an outer pipe 12 having an extended portion 12-1 on which a mount portion 12-2 is defined, an inner pipe 11 fit in the outer pipe 12 and having locking recesses 25 formed on an outer circumference of the inner pipe 11 at a predetermined distance from each other, a guide body 15 fit between the extended portion 12-1 and the inner pipe 11 and having an opening 24 formed in the middle portion, and also having seating portions 15-1, coil springs 22, each of which having one end connected to one end of each seating portion 15-1 of the guide body 15, an operating portion 17 to which the other end of each coil spring 22 is connected, and moved in the lengthwise direction by a recovering force of each coil spring 22, and having a pressing portion 17-1 formed on a lower middle portion, and also having escaping recesses 17-2 defined at both sides of the pressing portion 17-1, a slide 16 having a lower portion mounted on an upper surface of the operating portion 17 by fastening projections 17-3 in a manner of being exposed to the mount portion 12-2, and a roller 7 inserted in the opening 24, thus locked in or released from the locking recesses 25.

When the user moves the slide 16 in the lengthwise direction of the suction pipe 10, the roller 26 is released from the restricted state, and accordingly, the opening 24 is aligned with one of the escaping recess 17-2. Then when the user moves the inner pipe 11 in the lengthwise direction, the roller 26 is separated from the locking recess 25, and inserted in the escaping recess 17-2. Accordingly, the length of the suction pipe 10 can be adjusted appropriately. Then, as the user stops exerting the force to the slide 16, the slide 16 is returned to the middle portion of the guide body 15 by the recovering force of the coil springs 22, and accordingly, the pressing portion 17-1 of the operating portion 17 re-presses the roller 26.

In the conventional device for adjusting the length of the suction pipe, however, the operating portion 17 and the slide 16 have to be prepared separately, and then integrally assembled with each other. Further, the end of the outer pipe 12 should be extended to receive the guide body 15. Accordingly, the manufacturing process becomes complex.

In order to solve the above-mentioned problem of the prior art, the same applicant disclosed an improved device for adjusting the length of the suction pipe of the vacuum cleaner in the Korean Patent Application No. 99-16556 (Filed May 10, 1999 and entitled: Device for adjusting suction pipe length of a vacuum cleaner). According to the Korean Patent Application No. 99-16556 as shown in FIGS. 2A and 2B, a sleeve 3 having a long hole 3*a* is fastened at one end of an outer pipe 2. The long hole 3*a* is formed in the middle portion of the sleeve 3 in a circumferential direction. A pair of elastic rings 6 are disposed on the outer circumference of both ends of the sleeve 3 at a predetermined distance from each other, in a manner that certain portion of the elastic rings 6 are fixed on the outer circumference of the sleeve 3. The long hole 3*a* of the sleeve 3 receives a locking pin 5 which is locked in one of locking recesses 1*a* that are formed on the inner pipe 1 at a predetermined distance from each other in a lengthwise direction. On the inner circumference of the sleeve 3, guide projections 3*b* is formed for being inserted in one of guide grooves 1*b* formed on the outer circumference of the inner pipe 1 in the lengthwise direction. On the outer circumference of both ends of the sleeve 3, annular limiting projections 3*c* are formed, respectively. On the outer circumference of the sleeve 3, a sliding cover 4 is mounted. The sliding cover 4 has a pair of arc locking projections 4*a* formed on the inner circumference of the sliding cover 4 and positioned at the outer side of the annular rings 6, respectively. Between the locking projections 4*a,* there are formed a pressing projection 4*b* for pressing the locking pin 5, and a pair of escaping recesses 4*c* to which the locking pin 5 is selectively received, respectively.

Accordingly, by moving the sliding cover 4 forward or backward, one of the escaping recesses 4*c* is aligned with the locking pin 5. Accordingly, the locking pin 5 is released from the restricted state, and the inner pipe 1 can be moved freely with respect to the outer pipe 2. Then, by discontinuing an application of force to the sliding cover 4, the sliding cover 4 returned to the original position by the recovering force of the elastic ring 6, and accordingly, the locking pin 5 is inserted in one of the locking recesses I a of the inner pipe 1. Then, pressed by the pressing projection 4*b,* the inner pipe 1 is fixed at the position.

According to the Korean Patent Application No. 99-16556, the locking pin 5 is separately prepared and inserted in only one locking recess 1*a* of the inner pipe 1 to serve its function of fixing a position. Further, since the locking pin 5 is simply inserted in the long hole 3*a* of the sleeve 3, there is a possibility that the locking pin 5 may be separated. Further, the sleeve 3 and the sliding cover 4, which are made of metal material, does not operate smoothly, and also causes a considerable level of friction noise.

SUMMARY OF THE INVENTION

This device has been made to overcome the above-mentioned problems of the related arts, and accordingly, it is an object to provide a device for adjusting a length of a suction pipe of a vacuum cleaner, capable of firmly positioning an inner pipe at a desired location, regardless of external shocks, or the like.

Another object is to provide a device for adjusting a length of a suction pipe of a vacuum cleaner that is smoothly operated, while minimizing the level of friction noise.

The above objects are accomplished by a present device for adjusting a length of a suction pipe of a vacuum cleaner, including a sleeve securely connected to one end of an outer pipe, and having a pair of limiting projections formed on an outer circumference of the outer pipe in a circumferential direction and axially spaced from each other by a predetermined distance, a slot defined between the pair of limiting projections in an axial direction, and a guide projection formed on the inner circumference of the sleeve for being inserted in a guide recess formed on an outer circumference of an inner pipe in an axial direction of the inner pipe; a locking plate inserted in the slot of the sleeve, and having a pair of locking projections formed on a lower surface of the locking plate and inserted in at least a pair of neighboring locking recesses which are formed on the outer circumference of the inner pipe and spaced from each other by a predetermined distance in an axial direction; a pair of arc-shaped pressing plates connected between the pair of limiting projections of the sleeve for restricting the locking plate, the pressing plates having cam grooves, respectively, along which the pressing plates are moved in a circumferential direction to opposite directions to selectively release the locking plate; and a sliding cover movably connected on the outer circumference of the sleeve in an axial direction, and securely positioned at a predetermined position by elastic means, the sliding cover having operating projections which are movably inserted in the cam grooves of the pair of pressing plates.

According to the present device, the elastic means includes a seating recess formed on the outer circumference of the sleeve in an axial direction, facing the slot; a supporting projection formed on the inner circumference of the sliding cover and positioned in a middle of the seating groove, dividing the seating groove into a pair of half grooves; and coil springs inserted in the half grooves of the seating groove.

According to another preferred aspect of the present device, respective portions, such as the sleeve, the locking plate, the pressing plates, and the sliding cover, are formed of a rigid synthetic resin, such as an ABS, or the like.

Accordingly, since at least a pair of locking projections are locked in the pair of locking recesses of the inner pipe, the inner pipe can be securely positioned.

BRIEF DESCRIPTION OF THE DRAWINGS

The above object and other features of the present device will be clarified by the following description with the attached drawings, in which.

DETAILED DESCRIPTION OF THE PREFERRED EMBODIMENT

Figure 1:
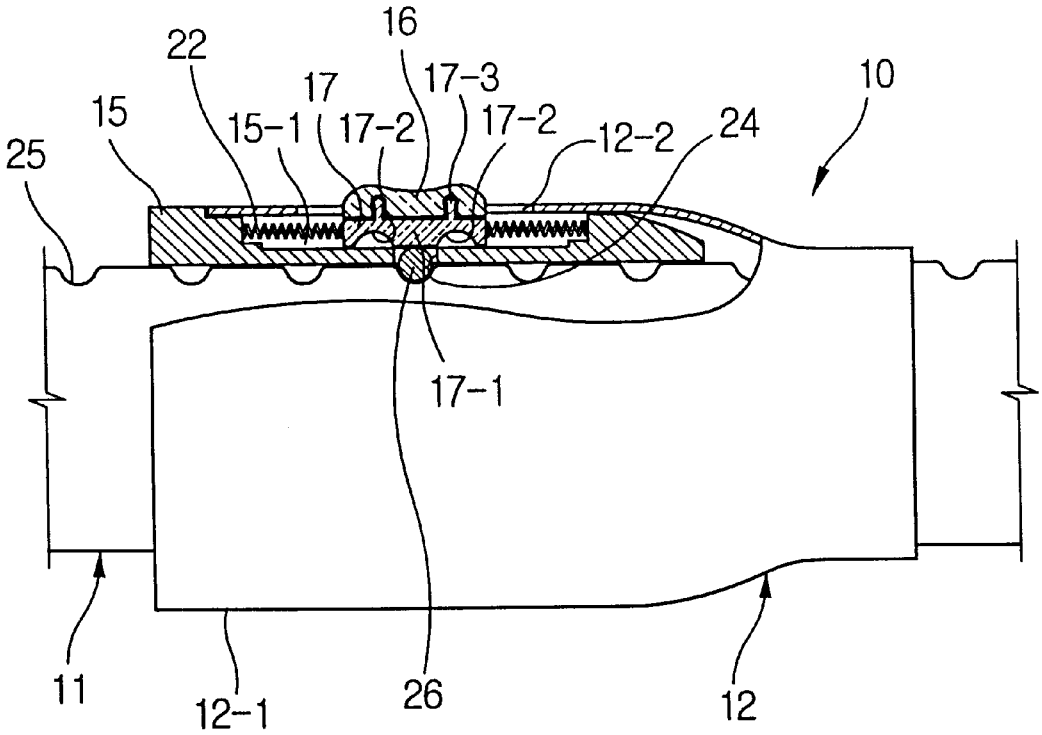
FIG. 1 PRIOR ART
FIG. 1 is a sectional view showing one example of a conventional device for adjusting a length of a suction pipe of a vacuum cleaner.
Figure 2A:
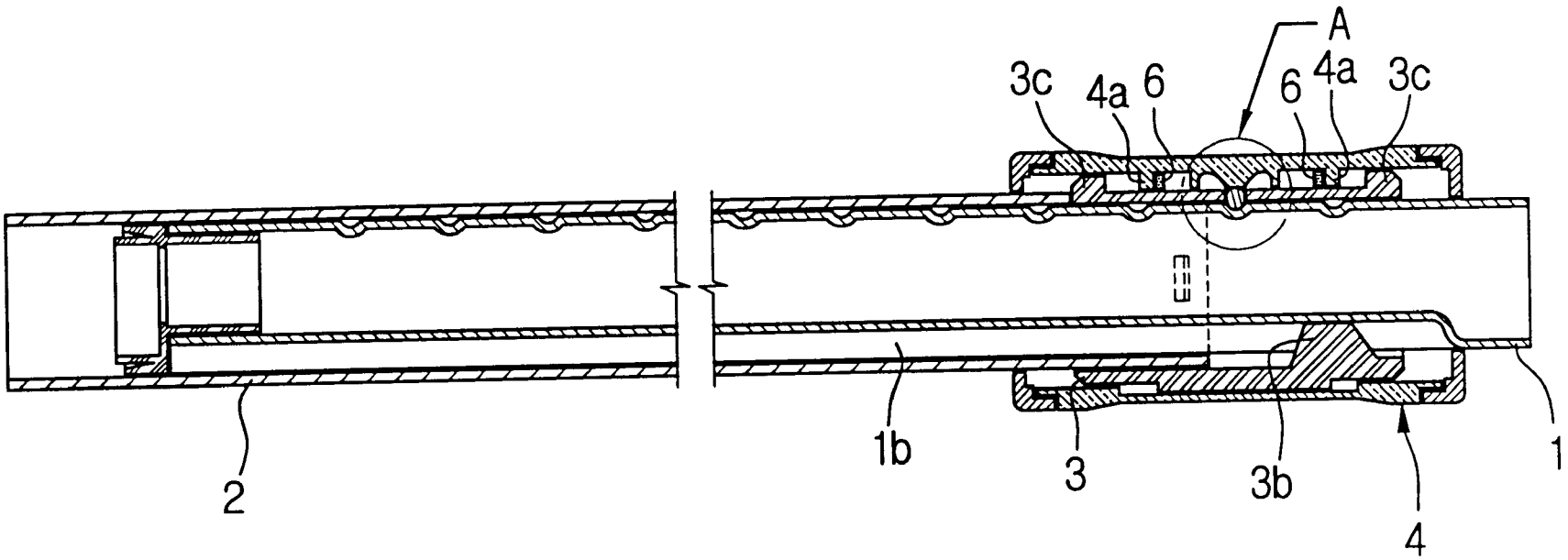
FIG.2A PRIOR ART
FIG. 2A is a sectional view showing a device for adjusting a length of a suction pipe of a vacuum cleaner according to Korean Patent Application No. 99-16556.
Figure 2B:
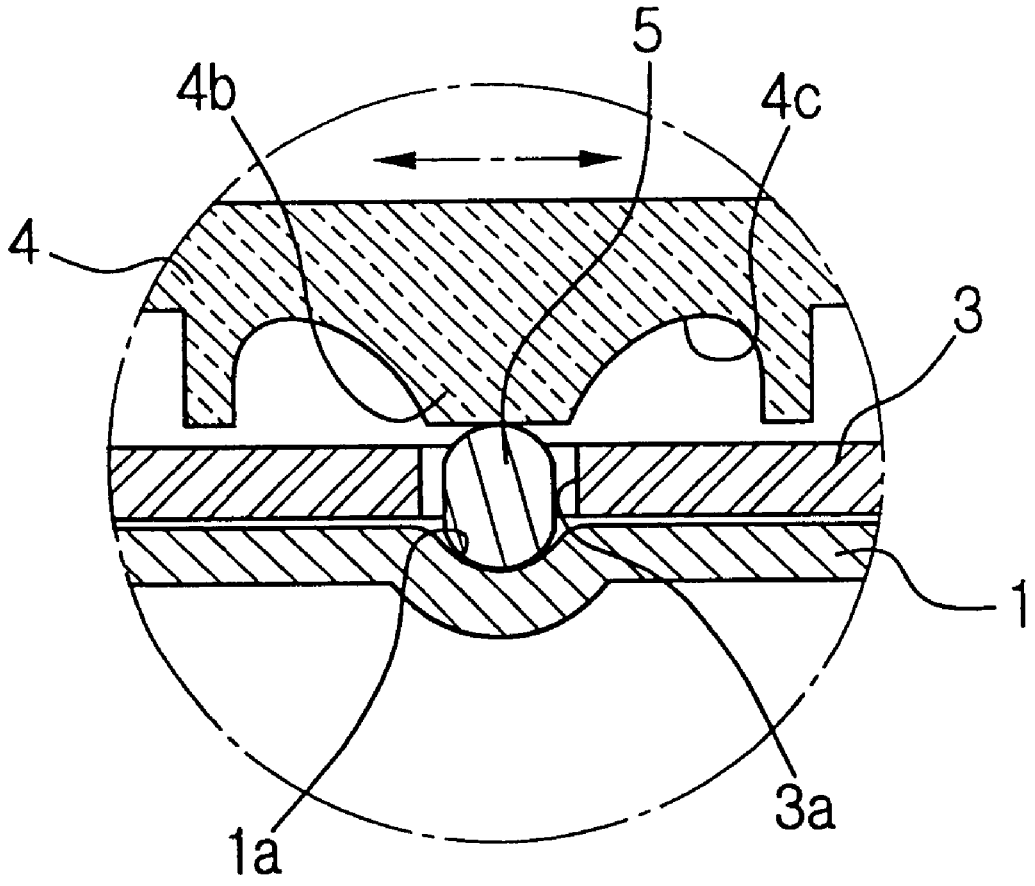
FIG.2B PRIOR ART
FIG. 2B is a sectional view showing an A-circled portion in detail.
Figure 3:
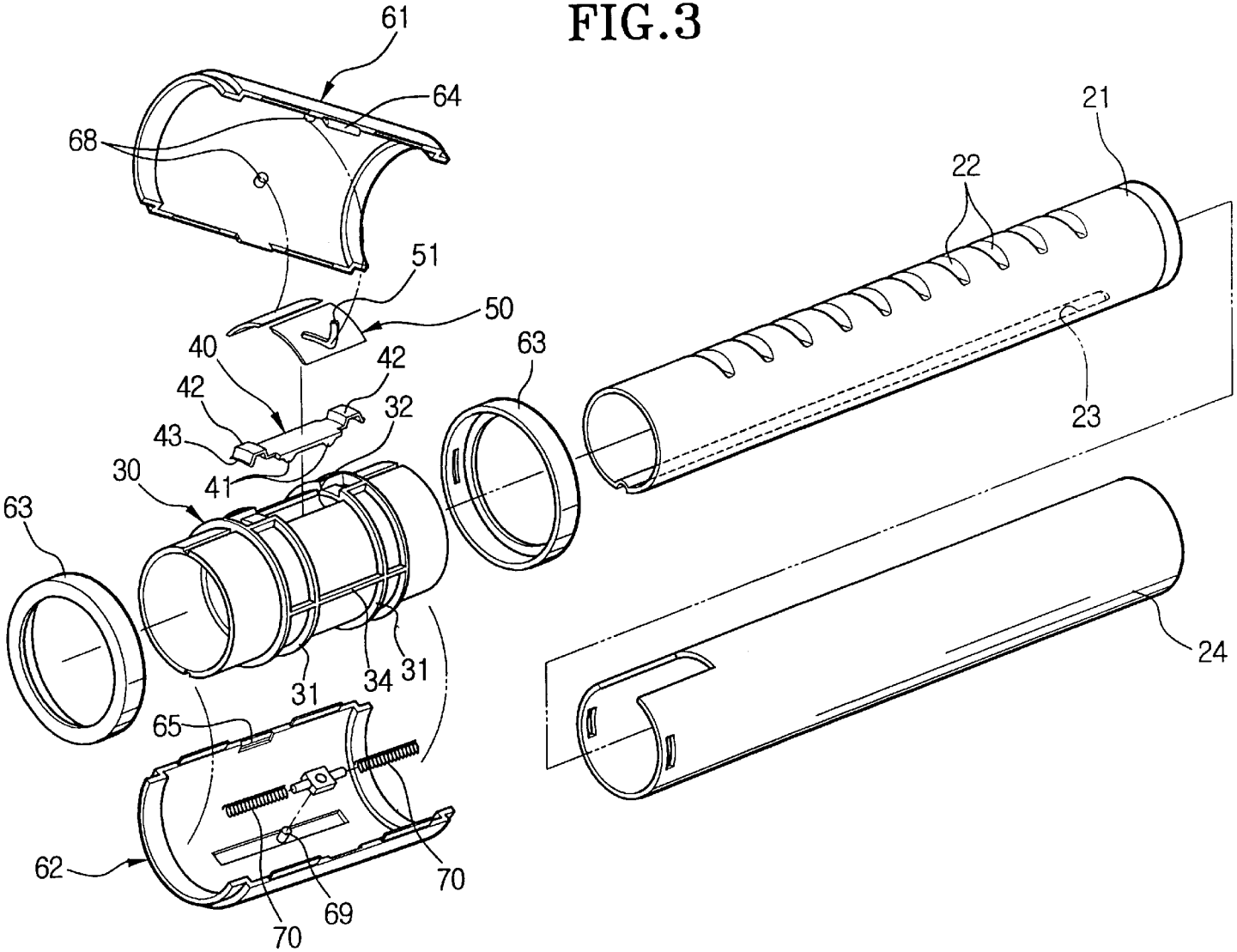
FIG. 3 is an exploded perspective view showing a present device for adjusting the length of a suction pipe of a vacuum cleaner.

This device will be described in further detail by way of example with reference to the attached drawings.

Referring to FIGS. 3 to 8, the device for adjusting the length of the suction pipe of the vacuum cleaner includes a sleeve 30 securely connected to one end of an outer pipe 24, a locking plate 40 passed through the sleeve 30 and locked in locking recesses 22 formed on an outer circumference of an inner pipe 21 at a predetermined distance from each other, a pair of pressing plates 50 for restricting the locking plate 40, and a sliding cover 60 connected to an outer circumference of the sleeve 30, for releasing the locking plate 40 from the pair of pressing plates 50 by reciprocating the pair of pressing plate 50 in a circumferential direction of the pair of pressing plates 50.

On the outer circumference of the sleeve 30, a pair of limiting projections 31 are formed to limit the movement of the sliding cover 60. The pair of limiting projections 31 is spaced from each other by a predetermined distance at an axial direction. Between the pair of limiting projections 31, a slot 32 is defined in an axial direction to receive the locking plate 40. On a certain portion of the outer circumference of the sleeve 30, a seating groove 33 is formed to correspond to the slot 32, while a guide rail 34 is protruded between the seating groove 33 and the slot 32 for guiding the movement of the sliding cover 60. On a certain portion of the inner circumference of the sleeve 30 corresponding to the seating groove 33, a guide projection 35 is formed to be inserted in a guide groove 23 which is defined on the outer circumference of the inner pipe 21 in an axial direction. On the inner circumference of one end of the sleeve 30, a locking projection 36 is formed to ensure that the outer pipe 24 is inserted by a predetermined length. Albeit not shown, a plurality of hooks are formed on the inner circumference of the sleeve 30 for being hooked in a hooking hole of the outer pipe 24 and thus fastening the outer pipe 24 integrally.

Figure 4:
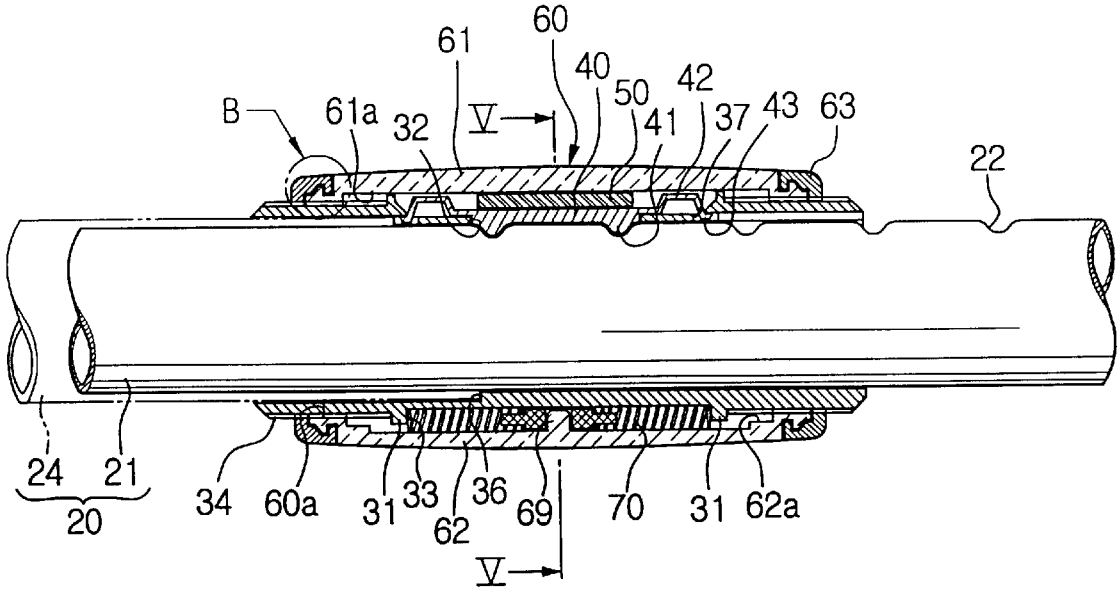
FIG. 4 is a sectional view showing the device being assembled.

On the lower surface of the locking plate 40, a pair of locking projections 41 is formed in a circumferential direction at a predetermined distance from each other, to be elastically inserted in the pair of neighboring locking recesses 22 of the outer pipe 24. The locking plate 40 can be simply inserted in the slot 32 of the sleeve 30, or more preferably, the locking plate 40 may include elastic portions 42 extending from lengthwise leading ends of the locking plate 40 to be securely connected on the sleeve 30 (see FIG. 4). The elastic portions can be formed in the fan-shape. Also, as shown in FIG. 4, the elastic portions 42 have bent portion for more elasticity thereof, and locking portions 43 formed on leading ends thereof for being locked in the locking slots 37.

The pair of pressing plates 50 is circular arc in shape, for being inserted in between the pair of limiting projections 31 of the sleeve 30. The pressing plates 50 are selectively moved in alternate direction. The pressing plates 50 have V-shaped cam grooves 51 so that the respective arms of each cam groove 51 are gradually spaced from each other toward the locking plate 40. It is preferable that each cam groove 51 has a slant side 52 that faces the locking plate 40 for more smooth contact with the locking plate 40.

The sliding cover 60 is in the shape of a cylinder that surrounds the sleeve 30, and has a guide groove 60*a* formed on the inner circumference of the sleeve 30 for receiving the guide rail 3. The sliding cover 60 includes an upper and a lower cover 61 and 62, respectively in the shape of semi-cylinder which are assembled with each other, and a pair of end covers 63 in the shape of a ring, respectively connected to both ends of an assembly of the upper and lower covers 61 and 62. On both ends of the upper cover 61, hooks 64 are formed in the circumferential direction, while hooking recesses 65 are formed on both ends of the lower cover 62 corresponding to both ends of the upper cover 61. The hooks 64 are elastically hooked in the hooking recesses 65. Further, fastening projections 66 are formed on the outer circumference of both leading ends of the upper and lower covers 61 and 62, while fastening recesses 67 are formed on the inner circumference of the pair of end covers 63 to receive the fastening projections 66 of the upper and lower covers 61 and 62. Operating projections 68 are formed on the inner circumference of the upper cover 61, to be movably inserted in the cam grooves 51 of the pair of pressing plates 50, while a supporting projection 69 is formed on the inner circumference of the lower cover 62 to be positioned in the middle of the seating hole 33 of the seating groove 33 in a manner of dividing the seating groove 33 into a left and a right grooves 33.

Meanwhile, the left and the right seating grooves 33 of the sleeve 30 that are divided by the supporting projection 69, respectively receive coil springs 70 for setting the sliding cover 60 at a predetermined position. Operating grooves 61*a* and 62*a* are formed on the inner circumference of the upper and lower covers 61 and 62, so that the limiting projections 31 of the sleeve 30 are movably inserted in the operating grooves 61*a* and 62*a* for reciprocating movement of the sliding cover 60 within a predetermined stroke.

The sleeve 30, the locking plate 40, the pair of pressing plates 50, and the sliding cover 60 are formed of rigid synthetic resin, such as an ABS, or the like.

Next, the operation for adjusting the length of the suction pipe will be described with reference to FIGS. 9A to 9D.

Figure 5:
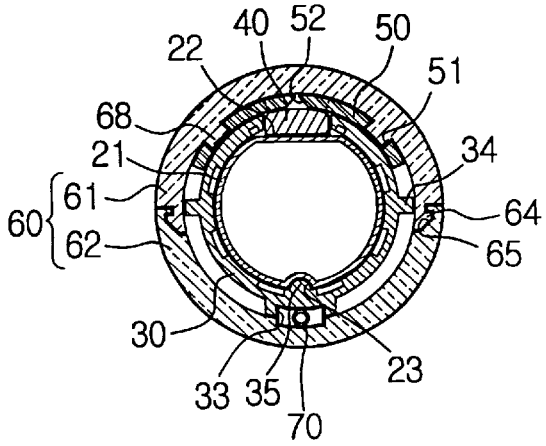
FIG. 5 is a sectional view taken on line V—V of FIG. 4.
Figure 6:
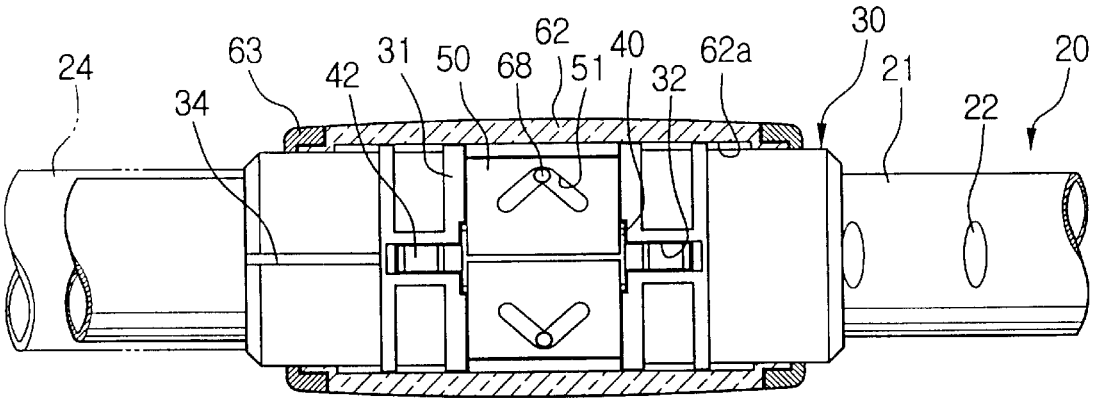
FIG. 6 is a plan view showing the present device of FIG. 4 from which an upper sliding cover is removed.
Figure 7:
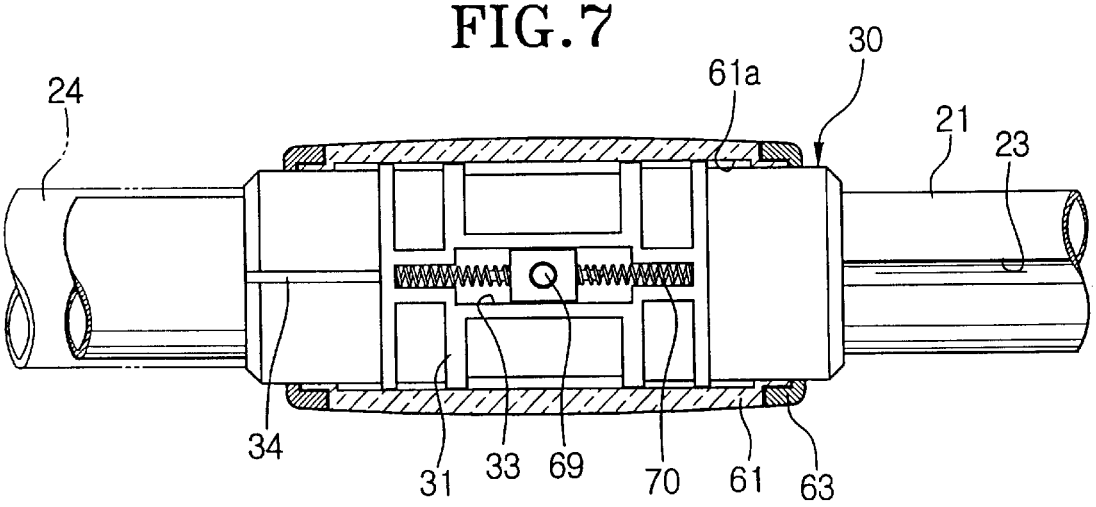
FIG. 7 is a bottom view showing the present device of FIG. 4 from which a lower sliding cover is removed.
Figure 8:
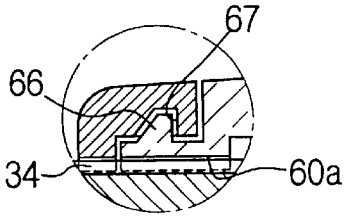
FIG. 8 is a sectional view showing a B-circled portion of FIG. 4 in detail.

FIGS. 4 to 6 show the locking projections 41 being locked in the locking recesses 22 of the inner pipe 21, and the pair of pressing plates 50 restricting the locking plate 40. In this situation, as shown in FIG. 6, the operating projections 68 of the sliding cover 60 are positioned at the lowest portion of the cam grooves 51 of the pair of pressing plates 50.

Figure 9A:
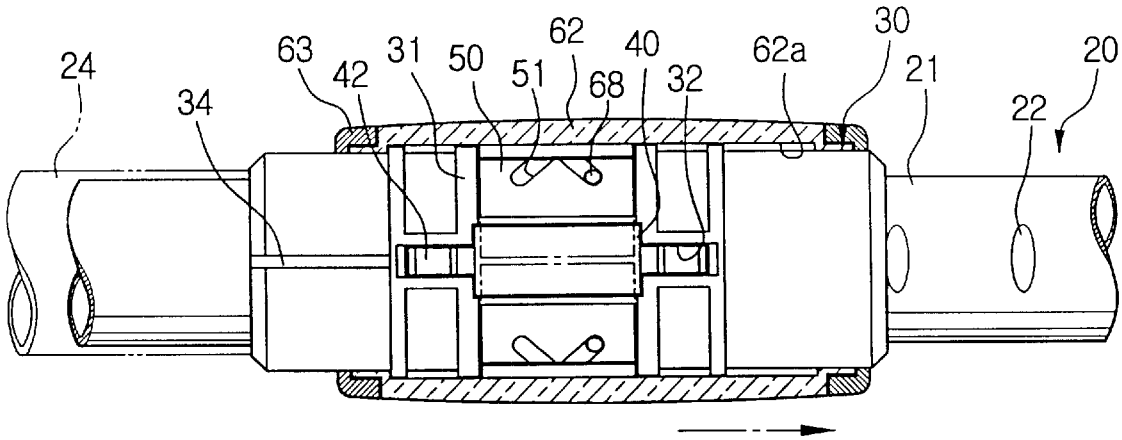
FIGS. 9A to 9D are sectional views showing the operation of the present device.
Figure 9B:
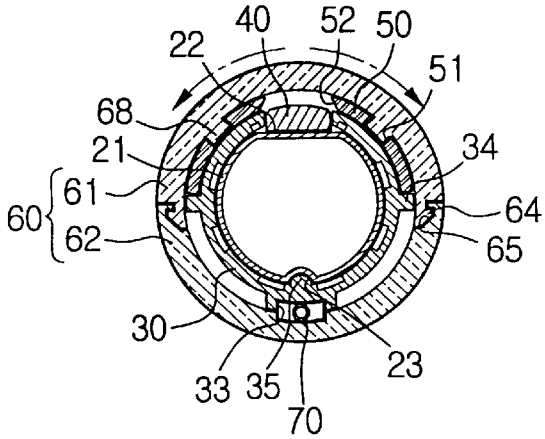
Figure 9C:
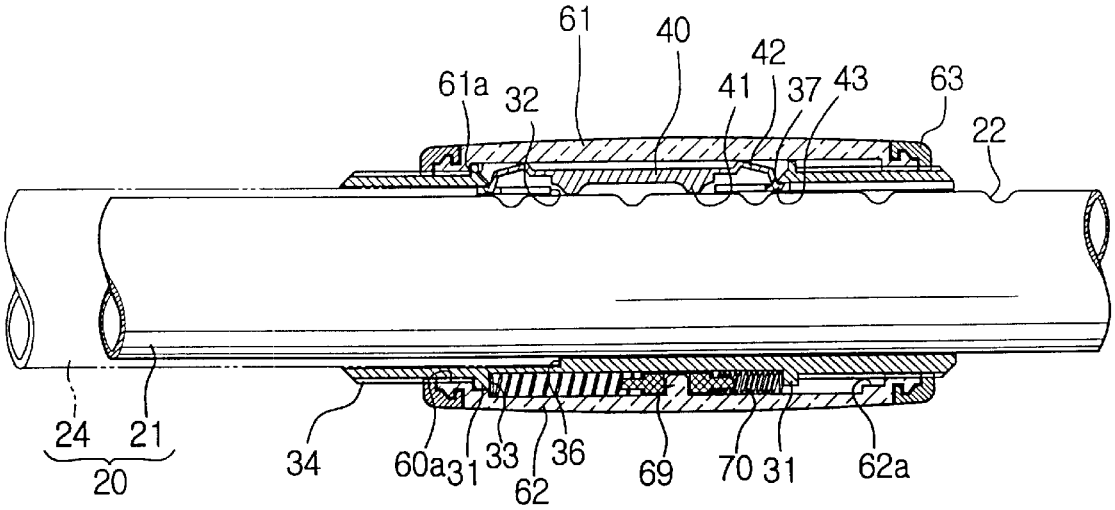

In such a situation, the user pushes or pulls the sliding cover 60, and accordingly, the operating projections 68 are simultaneously moved in the axial direction. Accordingly, the axial movement of the pair of pressing plates 50 is restricted by the limiting projections 31 of the sleeve 30, and as shown in FIGS. 9A and 9B, due to the V-shaped cam grooves 51 receiving the operating projections 68, the pair of pressing plates 50 are slid along the limiting projections 31 in a circumferential direction in a manner that the operating projections 68 are moved away from each other. Then the pressing plates 50 are separated from the locking plate 40. Since the locking plate 40 is released from the restriction of the pressing plates 50, the inner pipe 21 is moved freely with respect to the outer pipe 24.

Figure 9D:
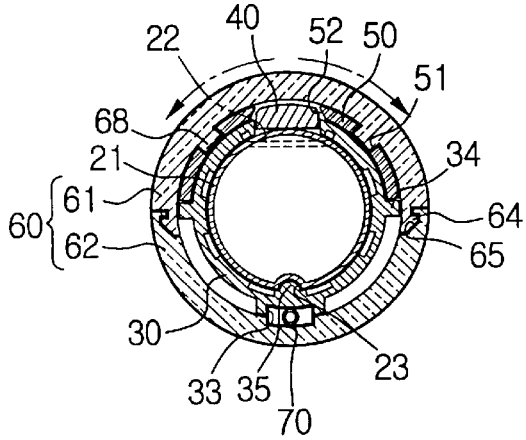

That is, in a state the locking plate 40 is released, by moving the inner pipe 21 to the extending direction of the suction pipe (FIG. 9C), the elastic portions 42 of the locking plate 40 are elastically displaced upwardly so that the limiting projections 41 are separated from the locking recesses 22 of the inner pipe 21 (FIG. 9D). Accordingly, the length of the suction pipe 20 can be adjusted. Since the locking plate 40 is usually elastic-biased downward by the elastic portions 42, the locking projections 41 are elastically locked in the locking recesses 22 of the inner pipe and the inner pipe 21 can be temporarily fixed at the adjusted position even without the external force.

Next, after adjusting the length of the suction pipe 20 appropriately, the external application is discontinued. Accordingly, by the recovering force of the coil springs 70, the sliding cover 60 is returned to its original position, i.e., to the middle position. Accordingly, by the operating projections 68 of the sliding cover 60 and the cam grooves 51 receiving the operating projections 68, the pair of pressing plates 50 are moved closer to each other, covering the upper portion of the locking plate 40. Accordingly, the locking plate 40 is restricted. Then the inner pipe 21 is fixed at the position that is predetermined with respect to the outer pipe 24.

As described above, according to the present device, the locking plate 40 has the pair of locking projections 41 that are spaced from each other, and locked in the pair of neighboring locking recesses 22. Since the position is fixedly secured by the pair of locking projections 41 inserted in the pair of neighboring locking recesses 22, separation of the locking projections 41 is prevented, and accordingly, the inner pipe 21 can be securely positioned at a desired location. Further, since the respective portions are formed of synthetic resin, and since the pressing plates are operated along the cam grooves, the operation of the suction pipe is performed smoothly, while the level of friction noise is minimized.

Accordingly, the present device for adjusting the length of the suction pipe improves the elegance and reliability of the vacuum cleaner, and also provides an improved convenience to the user.

Although the preferred embodiment of the present device has been described, it will be understood by those skilled in the art that the present. device should not be limited to the described preferred embodiment, but various changes and modifications can be made within the spirit and scope of the present device as defined by the appended claims.

What is claimed is:

1. A device for adjusting a length of a suction pipe of a vacuum cleaner, comprising:

a sleeve securely connected to one end of an outer pipe, and having a pair of limiting projections formed on an outer circumference of the outer pipe in a circumferential direction and axially spaced from each other by a predetermined distance, a slot defined between the pair of limiting projections in an axial direction, and a guide projection formed on the inner circumference of the sleeve for being inserted in a guide recess formed on an outer circumference of an inner pipe in an axial direction of the inner pipe;

a locking plate inserted in the slot of the sleeve, and having a pair of locking projections formed on a lower surface of the locking plate and inserted in at least a pair of neighboring locking recesses which are formed on the outer circumference of the inner pipe and spaced from each other by a predetermined distance in an axial direction;

a pair of arc-shaped pressing plates connected between the pair of limiting projections of the sleeve for restricting the locking plate, the pressing plates having cam grooves, respectively, along which the pressing plates are moved in a circumferential direction to opposite directions to selectively release the locking plate; and a sliding cover movably connected on the outer circumference of the sleeve in an axial direction, and securely positioned at a predetermined position by elastic means, the sliding cover having operating projections which are movably inserted in the cam grooves of the pair of pressing plates.

2. The device of claim 1, wherein the locking plate has a pair of elastic portions integrally formed on both ends of the locking plate for elastically biasing the locking plate to a downward direction.

3. The device of claim 1, wherein the elastic means comprises:

a seating recess formed on the outer circumference of the sleeve in an axial direction, facing the slot;

a supporting projection formed on the inner circumference of the sliding cover and positioned in a middle of the seating groove, dividing the seating groove into a pair of half grooves; and coil springs inserted in the half grooves of the seating groove.

4. The device of claim 1, wherein the pair of pressing plate have slant surfaces, respectively, which face the locking plate.

5. The device of any one of claims 1 to 4, wherein the sleeve, the locking plate, the pressing plates, and the sliding cover are formed of a rigid synthetic resin, respectively.

* * * * *